US009358677B2

(12) United States Patent
Kuhnle et al.

(10) Patent No.: US 9,358,677 B2
(45) Date of Patent: Jun. 7, 2016

(54) HAND-POWER TOOL COMPRISING AN OSCILLATION-DAMPING DEVICE

(75) Inventors: Axel Kuhnle, Freiberg A.N. (DE); Matthias Tauber, Bad Boll (DE); Juergen Bochert, Stuttgart (DE); Carsten Diem, Ludwigsburg (DE); Willy Braun, Neustetten (DE); Christian Wiedemann, Wiernsheim (DE); Joerg Kaiser, Schwieberdingen (DE); Patrick Heinen, Ludwigsburg (DE); Roger Hahn, Neuhausen (DE); Thomas Speda, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 622 days.

(21) Appl. No.: 13/515,788

(22) PCT Filed: Oct. 22, 2010

(86) PCT No.: PCT/EP2010/065979

§ 371 (c)(1),
(2), (4) Date: Aug. 28, 2012

(87) PCT Pub. No.: WO2011/072918

PCT Pub. Date: Jun. 23, 2011

(65) Prior Publication Data

US 2012/0318551 A1 Dec. 20, 2012

(30) Foreign Application Priority Data

Dec. 16, 2009 (DE) ..... 10 2009 054 723

(51) Int. Cl.
*B25F 5/00* (2006.01)
*B25D 17/24* (2006.01)

(52) U.S. Cl.
CPC ..... *B25F 5/006* (2013.01); *B25D 17/24* (2013.01); *B25D 2217/0092* (2013.01); *B25D 2250/121* (2013.01)

(58) Field of Classification Search
CPC ..... B25D 2217/0073; B25D 2217/0092; B25D 17/24; B25D 17/245; B25D 2250/245; B25F 5/006
USPC ..... 173/162.1, 162.2, 210, 211; 267/137
See application file for complete search history.

(56) References Cited

U.S. PATENT DOCUMENTS 4,478,293 A * 10/1984 Weilenmann et al. ..... 173/162.2
6,907,943 B2 * 6/2005 Ikuta ..... 173/117

(Continued)

FOREIGN PATENT DOCUMENTS

CN 101407051 A 4/2009
EP 1 736 283 A2 12/2006

(Continued)

OTHER PUBLICATIONS

International Search Report corresponding to PCT Application No. PCT/EP2010/065979, mailed Jan. 24, 2011 (German and English language document) (5 pages).

*Primary Examiner* — Stephen F Gerrity
*Assistant Examiner* — Joshua Kotis
(74) *Attorney, Agent, or Firm* — Maginot, Moore & Beck LLP

(57) ABSTRACT

A hand-power tool includes at least one oscillation-damping device that has at least one damping spring and a damping mass. The hand-power tool also includes a drive mechanism and a mechanism housing. The mechanism housing has a housing cover which is provided for closing a chamber in which the drive mechanism lies, and the housing cover has at least one fixing mechanism that at least partially fixes the oscillation-damping device in at least one operating state.

8 Claims, 8 Drawing Sheets

(Section A-A)

(56) References Cited

U.S. PATENT DOCUMENTS

| | | | | |
|---|---|---|---|---|
| 7,252,157 | B2 * | 8/2007 | Aoki | 173/162.2 |
| 7,451,833 | B2 * | 11/2008 | Hahn | 173/104 |
| 7,513,317 | B2 * | 4/2009 | Satou | 173/162.2 |
| 7,712,548 | B2 * | 5/2010 | Moessnang | 173/162.1 |
| 7,766,096 | B2 * | 8/2010 | Satou et al. | 173/162.2 |
| 8,261,854 | B2 * | 9/2012 | Kikuchi et al. | 173/211 |
| 2006/0289185 | A1 * | 12/2006 | Hahn | 173/210 |
| 2008/0179797 | A1 * | 7/2008 | Manschitz et al. | 267/137 |
| 2008/0308287 | A1 * | 12/2008 | Sugiyama et al. | 173/211 |
| 2009/0025949 | A1 * | 1/2009 | Aoki | B23D 51/16 173/162.1 |
| 2009/0090528 | A1 * | 4/2009 | Manschitz | B25D 17/24 173/162.1 |
| 2009/0223693 | A1 * | 9/2009 | Aoki | 173/211 |
| 2010/0132969 | A1 * | 6/2010 | Bito et al. | 173/162.2 |
| 2011/0024149 | A1 * | 2/2011 | Hecht et al. | 173/162.2 |
| 2011/0139477 | A1 * | 6/2011 | Kuhnle et al. | 173/162.2 |

FOREIGN PATENT DOCUMENTS

| | | | | |
|---|---|---|---|---|
| EP | 1 767 315 | A1 | | 3/2007 |
| EP | 1 792 692 | A2 | | 6/2007 |
| EP | 2 018 939 | A2 | | 1/2009 |
| EP | 2 100 698 | A2 | | 9/2009 |
| JP | 52109673 | A | * | 9/1977 |
| JP | 2006-062039 | A | | 3/2006 |
| JP | 2007-1005 | A | | 1/2007 |
| JP | 2009-45732 | A | | 3/2009 |
| JP | 2009-208208 | A | | 9/2009 |
| JP | 2009-248241 | A | | 10/2009 |
| WO | 2008/140030 | A2 | | 11/2008 |
| WO | WO 2008140030 | A2 | * | 11/2008 |

* cited by examiner (Section A-A)

(Section B-B)

(Section C-C)

(Section D-D)

(Section E-E)

(Section F-F)

HAND-POWER TOOL COMPRISING AN OSCILLATION-DAMPING DEVICE

This application is a 35 U.S.C. §371 National Stage Application of PCT/EP2010/065979, filed on Oct. 22, 2010, which claims the benefit of priority to Ser. No. DE 10 2009 054 723.1, filed on Dec. 16, 2009 in Germany, the disclosures of which are incorporated herein by reference in their entirety.

BACKGROUND

The disclosure relates to a portable power tool.

Already known from EP 1 736 283 A2 is a hand power tool comprising at least one vibration absorber device, which has at least one absorber spring and an absorber mass, and comprising a drive mechanism and a mechanism housing.

SUMMARY

The disclosure relates to a portable power tool having at least one vibration absorbing device which has at least an absorption spring, an absorption mass and a mechanism housing.

It is proposed that the mechanism housing has a housing cover that is provided to close a chamber in which the drive mechanism is disposed and that has at least one fastening means that, in at least one operating state, at least partially fastens the vibration absorber device. In particular, a "hand power tool" is to be understood to include all hand power tools considered appropriate by persons skilled in the art, such as, in particular, percussion drills, demolition hammers, rotary hammers, percussion hammers, rotary percussion screwdrivers and/or, advantageously, rotary and/or chipping hammers. A "vibration absorber device" is to be understood to be, in particular, a device that in at least one operating state generates, upon a hand power tool machine housing and/or upon the mechanism housing and, in particular, upon at least a handle of the hand power tool, a force that counteracts a vibration, in particular of the hand power tool housing. The vibration absorber device thereby advantageously enables the hand power tool to be operated with little vibration. Preferably, the vibration absorber device operates passively, i.e. without an energy supply, apart from the vibration energy. In particular, the term "absorber spring" is to be understood to be a spring provided to transfer to the absorber mass, in particular directly, a force that accelerates and/or retards the absorber mass. Advantageously, the absorber spring is realized as a helical compression spring. Alternatively or additionally, the absorber spring could have a rectangular cross section perpendicularly in relation to a spring direction, or a plurality of absorber springs could be disposed in an interleaved manner and/or coaxially. Likewise alternatively or additionally, the absorber spring could be realized as a different torsion, spiral, tension and/or gas spring considered appropriate by persons skilled in the art. An "absorber mass" is to be understood to be, in particular, a unit provided to reduce the vibration, in particular of the hand power tool housing, through an inertia by means of an acceleration force and/or a retardation force, in that, advantageously, it vibrates with an angle of phase displacement in relation to the hand power tool housing. In particular, a "drive mechanism" is to be understood to be a mechanism that converts a motion of a drive motor into a work motion, in particular a percussive motion. A "mechanism housing" is to be understood to be, in particular, a housing in which at least the drive mechanism is disposed in a protected manner. Advantageously, the mechanism housing is realized so as to be at least partially integral with the hand power tool housing. Advantageously, the mechanism housing is provided to remove bearing forces, at least of the drive mechanism. A "housing cover" is to be understood to be, in particular, an element of the mechanism housing that is realized so as to be non-destructively separable from another element of the mechanism housing, in particular a housing shell. Preferably, the housing cover is provided to close an opening in the other element of the mechanism housing, in particular an opening provided for mounting the drive mechanism. Advantageously, the housing cover is free of bearing forces of the drive mechanism. Particularly advantageously, the housing cover transfers, in particular, mainly forces of the vibration absorber device and, in particular, forces that act upon the bearing cover from outside. "Provided" is to be understood to mean, in particular, specially equipped and/or designed. In particular, the term "close" is to be understood to mean that the housing cover covers over an opening of the other element of the mechanism housing, in particular a housing shell, when in a state of operational readiness. The housing cover thereby protects the chamber against soiling, i.e. it prevents dirt and, in particular, dust from entering through the opening to the drive mechanism. A "fastening means" is to be understood to be, in particular, a means provided to effect upon the vibration absorber device a force that immovably fastens at least one element of the vibration absorber device, preferably a holding part, relative to the mounted housing cover. Advantageously, the fastening means is realized so as to be at least partially integral with the housing cover. The fastening means is realized as a groove, as part of a screwed connection, as part of a latched connection and/or as part of another connection considered appropriate by persons skilled in the art. The design according to the invention makes it possible to achieve, with a simple structure, a particularly robust, compact and inexpensive hand power tool that can be operated with particularly little vibration. In particular, dispensing with an additional absorber cover makes it possible to achieve a particularly light hand power tool having an effective dissipation of heat from the drive mechanism.

In a further design, it is proposed that the vibration absorber device and the drive mechanism are disposed in the chamber closed by the housing cover, i.e. the vibration absorber device is disposed on an inner side of the housing cover. Advantageously, the chamber is realized as a grease chamber of the hand power tool. Since the vibration absorber device is disposed in the chamber, it is protected, in a structurally simple and particularly advantageous manner, against external influences such as dirt and mechanical damage. Further, the vibration absorber device can be lubricated, together with the drive mechanism, in a non-elaborate manner, such that there is little wear and good utilization of lubricant can be achieved. In addition, the vibration absorber device is rapidly heated by the drive mechanism, for example after a cold start, thereby further reducing wear and rendering possible a very constant characteristic frequency of the vibration absorber device.

Furthermore, it is proposed that the housing cover and the vibration absorber device constitute a structural unit that can be preassembled, such that assembly is advantageously non-elaborate. The expression "constitute a structural unit that can be preassembled" is to be understood to mean, in particular, that the housing cover and the vibration absorber device can be fixedly connected to each other in an assembly operation, in particular before the housing cover is fastened to the mechanism housing. As a result, the housing cover and the vibration absorber device can be connected to form a mountable unit. Advantageously, the housing cover and the vibration absorber device can be connected to each other such that they can be mounted jointly. Particularly advantageously, the housing cover and the vibration absorber device can be connected to each other such that they can transfer the acceleration force and/or a counter force of the acceleration force.

Further, it is proposed that at least the absorber spring, in at least one operating state, effects a fastening force upon the housing cover, enabling assembly to be achieved in a particularly non-elaborate manner. In particular, the expression "effect a fastening force" is to be understood to mean that the absorber spring exerts upon the housing cover a force that counteracts a motion of at least a part of the vibration absorber device. Advantageously, the fastening force counteracts a motion of a holding part of the vibration absorber device. Preferably, the fastening force prevents a motion of the holding parts.

In addition, it is proposed that the drive mechanism has a percussion mechanism, wherein the percussion mechanism and the vibration absorber device are at least partially disposed on at least one same plane that is aligned perpendicularly in relation to a spring direction, thereby making it possible to achieve a particularly effective vibration damping and, advantageously, good thermal coupling between the percussion mechanism and the vibration absorber device, and an advantageous utilization of space. A "percussion mechanism" is to be understood to be, in particular, a device that converts a rotary motion, in particular of the drive motor, into a linear percussive motion. Advantageously, the percussion mechanism is realized as a hammer percussion mechanism. Alternatively, the percussion mechanism could be realized as a ratchet percussion mechanism or as another percussion mechanism considered appropriate by persons skilled in the art. In particular, the expression, "at least partially disposed on a plane" is to be understood to mean that the plane intersects the percussion mechanism. A "spring direction" is to be understood to be, in particular, at least one direction in which the absorber spring must be loaded so as to be most able to elastically store energy. Advantageously, the absorber spring is realized so as to be elastically deformable in a spring direction by at least 25% of a length in a non-loaded state. Advantageously, the vibration absorber device at least partially encloses the percussion mechanism. This means that the vibration absorber device surrounds at least a point of the percussion mechanism on a plane by more than 180 degrees.

Furthermore, it is proposed that the vibration absorber device has at least one first and one second holding part, wherein the first holding part and the second holding part are supported against each other through the absorber spring, such that the structural space required is particularly small, and an advantageously rectilinear flux of force can be achieved. A "holding part" is to be understood to be, in particular, an element of the vibration absorber device that, in a mounted operating state, is connected to the housing cover so as to be immovable relative to the housing cover. Advantageously, forces resulting from an acceleration are transferred by the holding part from the absorber spring to the housing cover. Preferably, the holding part and the absorber spring are directly connected to each other. In particular, the holding part is a component realized so as to be separate from the mechanism housing and, preferably, from a housing cover. Advantageously, the holding part, when in a mounted operating state, exerts a force upon at least one element of a drive mechanism. In particular, the expression "through the absorber spring" is to be understood to mean that the absorber spring, as viewed in the spring direction, completely encloses the holding part. In this case, the holding part and the region of the spring that encloses the holding part are at least partially disposed on one same plane that is aligned perpendicularly in relation to the spring direction. "Bear against each other" is to be understood to mean, in particular, that the first and the second holding part are connected to each other so as to be immovable relative to each other during operation. Preferably, the second holding part bears in an inelastic manner exclusively on the first holding part, i.e., in particular, the second holding part is unconnected to the transmission housing.

In an advantageous realization of the disclosure, it is proposed that the vibration absorber device has at least one holding part and has at least one spring receiver that, in at least one operating state, exerts an acceleration force upon the absorber mass and, in at least one operating state, supports a counter force of the acceleration force on the holding part, making it possible to achieve a particularly small structural space requirement and low costs. Advantageously, the spring receiver exerts the acceleration force at one instant and, at another instant, supports the counter force. A "spring receiver" is to be understood to be, in particular, an element of the vibration absorber device that is disposed in a flux of force between the absorber spring and the absorber mass. Advantageously, the spring receiver is connected to the absorber mass in a mechanically fixed manner. Preferably, the spring receiver is movable relative to the mechanism housing. In particular, an "acceleration force" is to be understood to be a force that accelerates and/or retards the absorber mass. A "counter force" is to be understood to be, in particular, a force that supports the absorber spring on one side when another side of the absorber spring exerts the acceleration force upon the absorber mass.

In a further design, it is proposed that the vibration absorber device has at least one support element that, in at least one operating state, presses the spring receiver against the absorber spring, making it possible to achieve a particularly non-elaborate design, as well as an advantageous spring characteristic of the vibration absorber device and an advantageous tolerance compensation. In particular, it is possible to dispense with a positive, integral and/or frictional connection between the spring receiver and the absorber mass. A "support element" is to be understood to be, in particular, an element that, in at least one operating state, effects upon the spring receiver a force that counteracts a force that is effected by the absorber spring upon the spring receiver. Advantageously, the support element is realized as a cylindrical compression spring, as an elastomer part, as a zigzag or disk spring, and/or as another element considered appropriate by persons skilled in the art. Preferably, the force of the support element upon the spring receiver, in at least one operating state, is always significantly less, advantageously, than a force of the absorber spring on the same spring receiver. "Significantly less" in this context is to be understood to mean, in particular, less than 50%, advantageously less than 25%, particularly advantageously less than 10% of the force of the absorber spring. Alternatively, it would also be possible to dispense with support elements in the vibration absorber device.

Furthermore, it is proposed that the absorber spring is disposed entirely in an axial region of the absorber mass, thereby making it possible to achieve an advantageously small structural length in the spring direction. An "axial region of the absorber mass" is to be understood to be, in particular, a region delimited by two planes that are aligned perpendicularly in relation to the spring direction and that intersect the absorber mass.

BRIEF DESCRIPTION OF THE DRAWING

Further advantages are given by the following description of the drawing. Four exemplary embodiments of the disclosure are represented in the drawing. The drawing, the description and the claims contain numerous features in combination. Persons skilled in the art will, expediently, also consider the features individually and combine them to form appropriate, further combinations.

In the drawing.

DETAILED DESRIPTION

Figure 1:
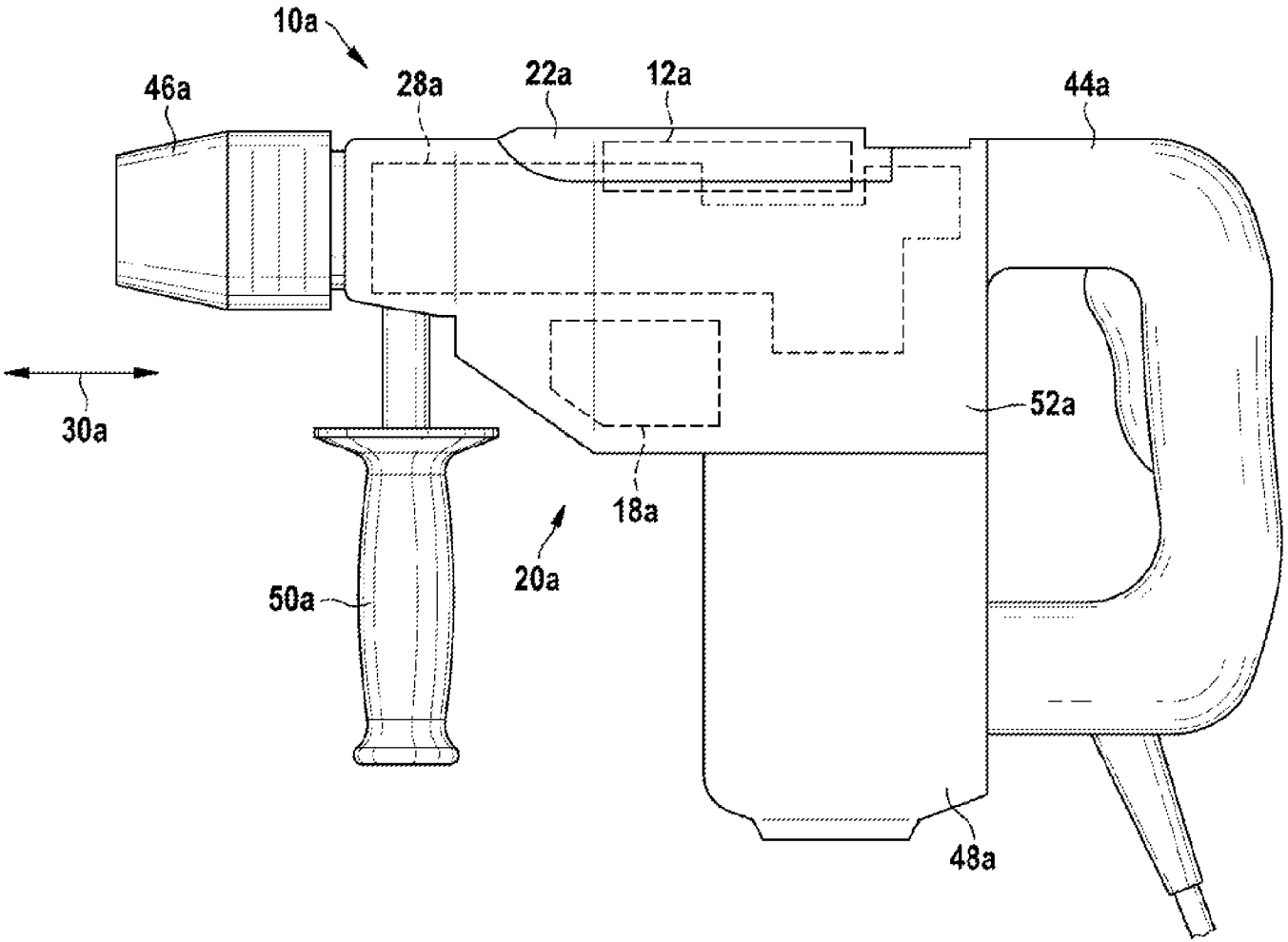
FIG. 1 shows a hand power tool according to the disclosure, comprising a vibration absorber device fastened to a housing cover.

FIG. 1 shows a hand power tool 10*a* according to the disclosure, comprising a vibration absorber device 12*a* and a drive mechanism 18*a*, and comprising a mechanism housing 20*a* that has a metallic housing cover 22*a*. The hand power tool 10*a* is realized as a rotary and chipping hammer. The mechanism housing 20*a* encloses a chamber 24*a*, in which the drive mechanism 18*a* and the vibration absorber device 12*a* are disposed. Further, the hand power tool 10*a* has a main handle 44*a*, an insert tool fastening device 46*a*, a motor housing 48*a* and an auxiliary handle 50*a*. On a side of the mechanism housing 20*a* that faces away from the insert tool fastening device 46*a*, the main handle 44*a* is connected to the mechanism housing 20*a* and to the motor housing 48*a*. On a side that faces toward the insert tool fastening device 46*a*, the auxiliary handle 50*a* is connected to the mechanism housing 20*a*.

Figure 2:
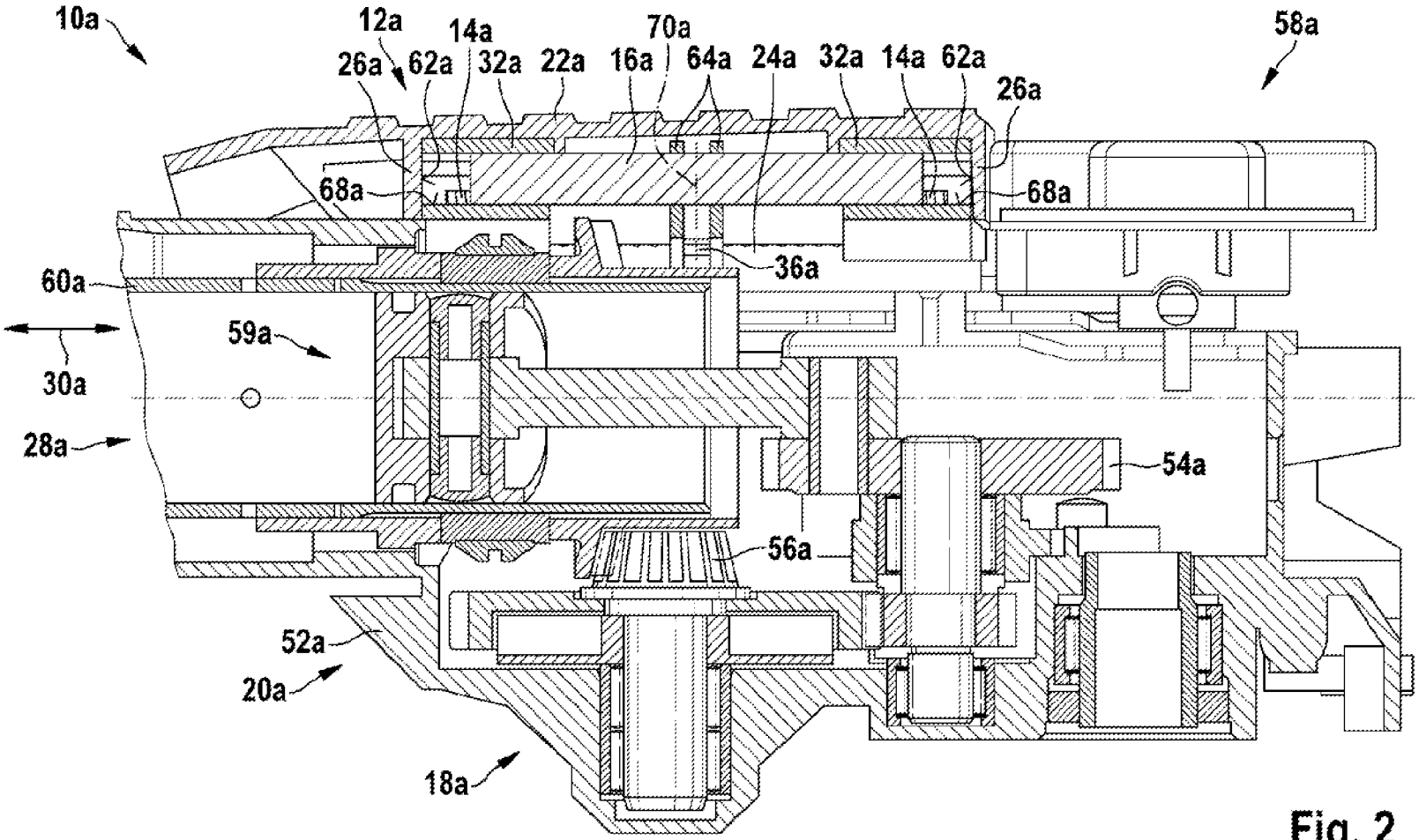
FIG. 2 shows a section through the hand power tool from FIG. 1.
Figure 3:
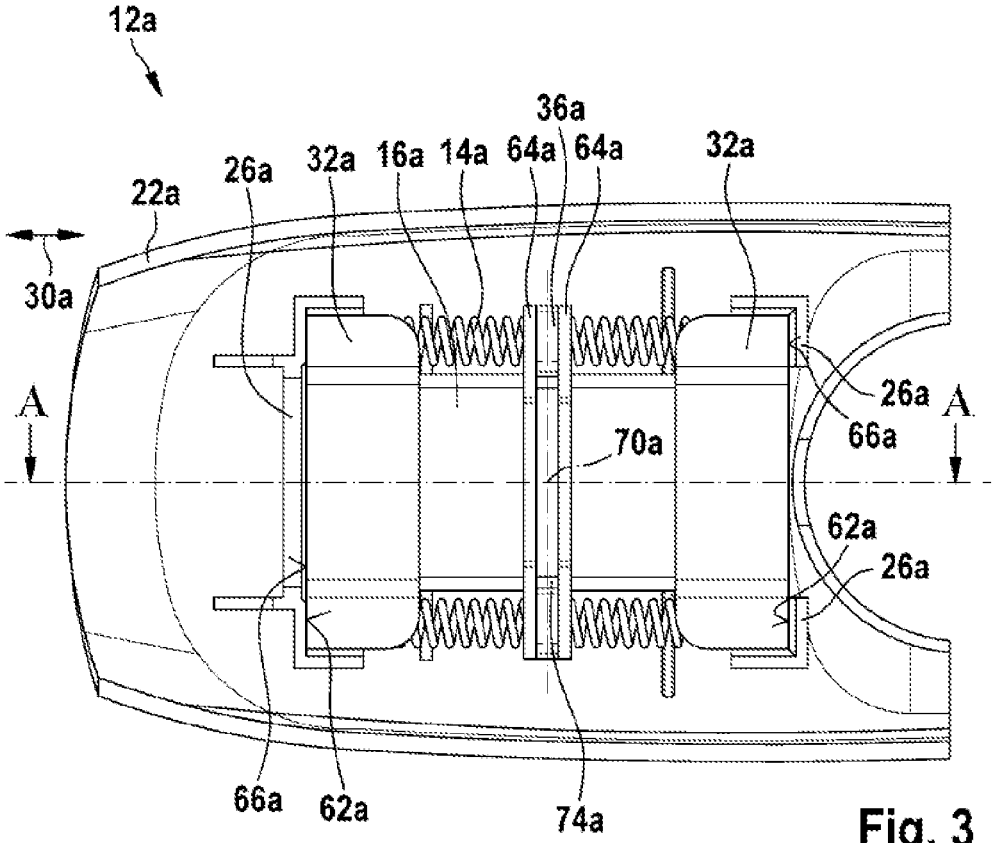
FIG. 3 shows a housing cover and the vibration absorber device of the hand power tool from FIG. 1.
Figure 4:
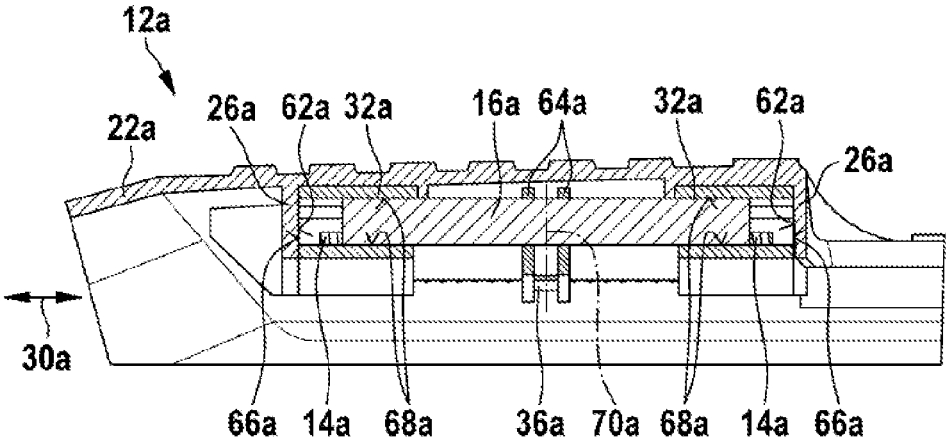
FIG. 4 shows a section (A-A) through the housing cover and the vibration absorber device.

FIG. 2 shows a section through the mechanism housing 20*a*, which, besides the housing cover 22*a*, has a housing shell 52*a*. The vibration absorber device 12*a* and the drive mechanism 18*a* are disposed in the chamber 24*a*. The drive mechanism 18*a* has a percussion mechanism 28*a*, a first and a second transmission element 54*a*, 56*a* for rotary operation, and a switchover mechanism 58*a*. The percussion mechanism 28*a* is realized as a hammer percussion mechanism. The first transmission element 54*a* is additionally realized as an eccentric element of the percussion mechanism 28*a*. Furthermore, the percussion mechanism 28*a* has a piston 59*a*, a hammer tube 60*a* and, not represented in greater detail, a striker and a ram. The second transmission element 56*a* drives the hammer tube 60*a* in rotation. The rotary motion of the hammer tube 60*a* can be switched off by the switchover mechanism 58*a* in a manner considered appropriate by persons skilled in the art.

The housing cover 22*a* of the mechanism housing 20*a* is disposed on a side of the housing shell 52*a* that is opposite the motor housing 48*a*. It closes an assembly opening located there, and thus closes the chamber 24*a*. The hand power tool 10*a* has a seal, not represented in greater detail, which is disposed between the housing cover 22*a* and the housing shell 52*a*. The vibration absorber device 12*a* and the drive mechanism 18*a* are thereby protected against soiling. The chamber 24*a* is realized as a grease chamber, i.e. a common, permanent lubrication is provided in the chamber. The vibration absorber device 12*a* and the drive mechanism 18*a* are disposed in the chamber 24*a* closed by the housing cover 22*a*.

As shown by FIGS. 3 to 7, the housing cover 22*a* has three fastening means 26*a*. The fastening means 26*a* are realized as formed-on webs. The fastening means 26*a* have fastening surfaces 62*a* aligned perpendicularly in relation to a spring direction 30*a*. The fastening means 26*a* fasten after mounting of a structural unit, i.e. after the vibration absorber device 12*a* has been inserted in the cover, and during operation fasten the vibration absorber device 12*a* in the spring direction 30*a*. For this purpose, during a mounting operation the vibration absorber device 12*a* is compressed in the spring direction 30*a* and inserted in the housing cover 22*a*. As a result, through biasing in the spring direction 30*a*, absorber springs 14*a* of the vibration absorber device 12*a* effect a fastening force upon the housing cover 22*a* after mounting of a structural unit and during operation. The fastening force fastens the vibration absorber device 12*a* non-positively and perpendicularly in relation to the spring direction 30*a*, to the housing cover 22*a*. The vibration absorber device 12*a* and the housing cover 22*a* thus form a structural unit that can be preassembled, i.e. the vibration absorber device 12*a* and the housing cover 22*a* together, and separately from the housing shell 52*a*, form a unit that is stable per se.

After the housing cover 22*a* has been mounted on the housing shell 52*a*, the housing shell 52*a* effects a fastening force upon the vibration absorber device 12*a*, in a region not represented in greater detail. The fastening force acts perpendicularly in relation to the spring direction 30*a*. Alternatively or additionally, the vibration absorber device 12*a* could be latched, screwed, adhesive bonded and/or connected to the housing cover 22*a* in another manner considered appropriate by persons skilled in the art.

The percussion mechanism 28*a* and the vibration absorber device 12*a* are disposed partially on the same planes, which are aligned perpendicularly in relation to a spring direction 30*a*, i.e. the percussion mechanism 28*a* and the vibration absorber device 12*a* are disposed partially adjacently. A region of the vibration absorber device 12*a* that faces toward the insert tool fastening device 46*a* is disposed between the housing cover 22*a* and the percussion mechanism 28*a*. This region has no functional component apart from the vibration absorber device 12*a*.

The vibration absorber device 12*a* is realized so as to be mirror-symmetrical when in a non-operative state. It has the four absorber springs 14*a*, an absorber mass 16*a*, two holding parts 32*a*, two spring receivers 36*a*, and two spring receiver fastening devices 64*a*. The two holding parts 32*a* are realized as like parts, i.e. they have the same shape, but mirrored in relation to each other. In addition, the holding parts 32*a* have a slight oversize relative to the housing cover 22*a*. Outsides 66*a* of the holding parts 32*a*, which face toward or away from the insert tool fastening device 46*a*, fasten the vibration absorber device 12*a* in the housing cover 22*a*. The absorber springs 14*a*, the absorber mass 16*a*, the two spring receivers 36*a* and the two spring receiver fastening devices 64*a* are disposed between the holding parts 32*a*. The spring receivers 36*a* and the spring receiver fastening devices 64*a* are produced, at least partially, from plastic.

The holding parts 32*a* have guide surface 68*a*, which guide the absorber mass 16*a* in the spring direction 30*a* during operation. For this purpose, the holding parts 32*a* enclose the absorber mass 16*a* on a plane that is realized perpendicularly in relation to the spring direction 30*a*. In this exemplary embodiment, the holding parts 32*a* enclose the absorber mass 16*a* completely. Alternatively, the holding parts 32 could enclose the absorber mass 16*a* by more than 180 degrees. The holding parts 32*a* guide the absorber mass 16*a* on surfaces disposed farthest from a center of gravity 70*a* of the absorber mass 16*a*, enabling slight guiding forces and a slight friction to be achieved. Alternatively or additionally, a housing cover could also guide the absorber mass 16*a* and/or the absorber spring 14*a*. Furthermore, the holding parts 32*a* each have spring fastening devices 72*a*, which fasten the absorber springs 14*a*. For this purpose, the absorber springs 14*a* are screwed onto the spring fastening devices 72*a*.

Figure 5:
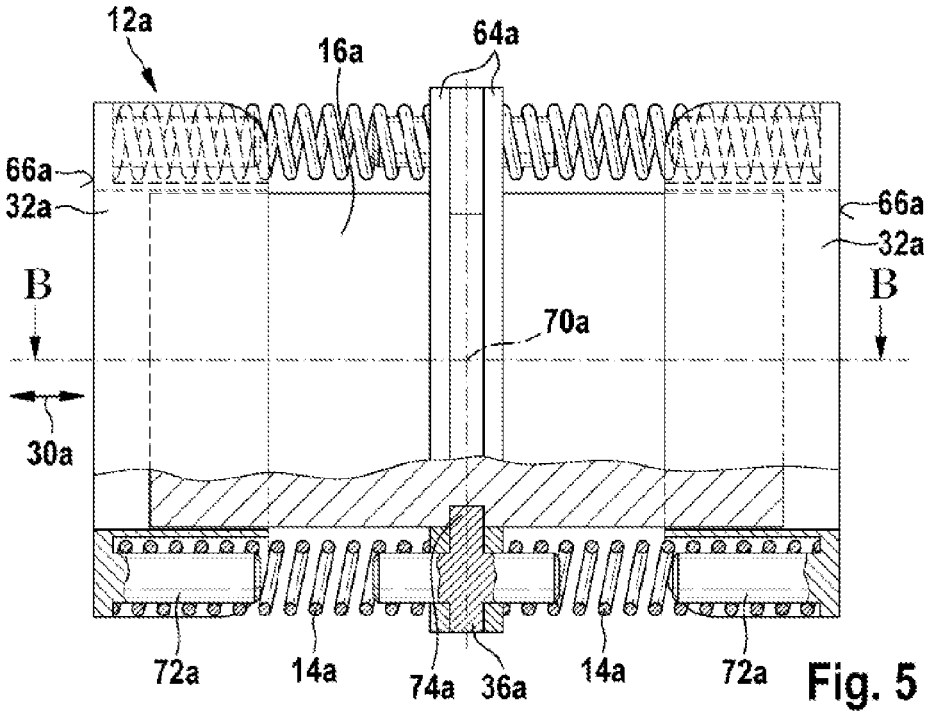
FIG. 5 shows a partial section of the vibration absorber device of the hand power tool from FIG. 1, in a top view.
Figure 6:
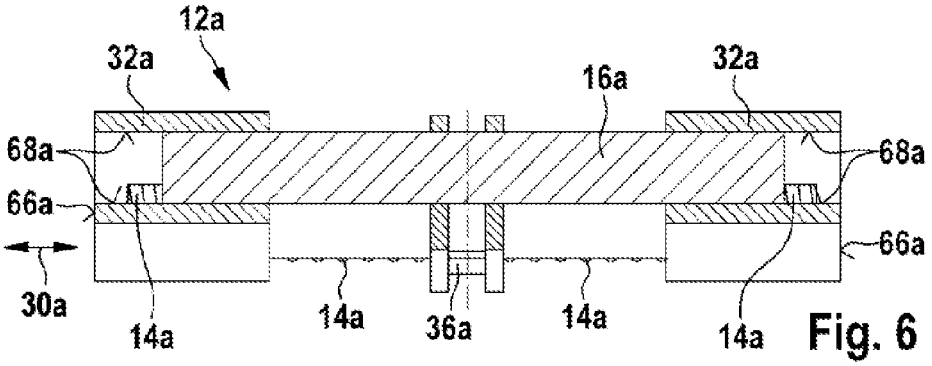
FIG. 6 shows a section (B-B) of the vibration absorber device of the hand power tool from FIG. 1, in a front view.
Figure 7:
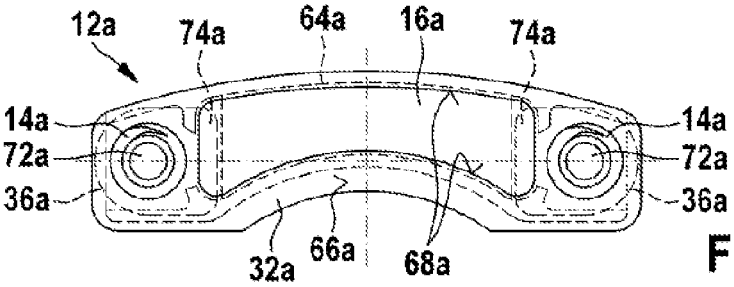
FIG. 7 shows the vibration absorber device of the hand power tool from FIG. 1, in a side view.

The four absorber springs 14*a* are each mechanically connected in a fixed manner on one side to the holding parts 32*a*, and on one side to the spring receivers 36*a*. The spring receivers 36*a*, as viewed perpendicularly in relation to the spring direction 30*a*, have a cross-shaped cross section (FIG. 5). On a side that faces toward the center of gravity 70*a* of the absorber mass 16*a*, the spring receivers 36*a* extend into recesses 74*a* of the absorber mass 16*a*. The spring receivers 36*a* in this case are supported on the absorber mass 16*a*. During a mounting operation, the spring receiver fastening devices 64*a* are pushed onto the absorber mass 16*a* and fix the spring receivers 36*a*, such that a positive connection is produced between the spring receivers 36*a* and the absorber mass 16*a*. The spring forces of the absorber springs 14*a* fasten the spring receiver fastening device 64*a*.

In addition, the vibration absorber device 12*a* could have damping elements, not represented in greater detail, which damp an impact of the absorber mass 16*a* on an end stop. For example, the damping elements could be disposed between the spring receivers 36*a* and the holding parts 32*a* inside the absorber springs 14*a*, in a guide of the holding parts 32*a* or on the housing cover 22*a*.

The absorber mass 16*a* has a homogeneous cross section in the spring direction 30*a*. The cross section is formed by means of a bar extrusion method. Absorber masses are cut off from a bar by a machine and, in the same working step, are provided with recesses for receiving spring receivers. Alternatively or additionally, an absorber mass could have a plurality of mass parts. Advantageously, at least one of the mass parts likewise has a homogeneous cross section. Particularly advantageously, at least one of the mass parts preferably has, for the most part, a standard cross section along at least one direction.

Three further exemplary embodiments of the disclosure are shown in FIGS. 8 to 14. To distinguish the exemplary embodiments, the letter a in the references of the exemplary embodiment in FIGS. 1 to 7 is replaced by the letters b to d in the references of the exemplary embodiments in FIGS. 8 to 14. The descriptions that follow are limited substantially to the differences between the exemplary embodiments and, in respect of components, features and functions that remain the same; reference may be made to the description of the other exemplary embodiments, in particular in FIGS. 1 to 7.

Figure 8:
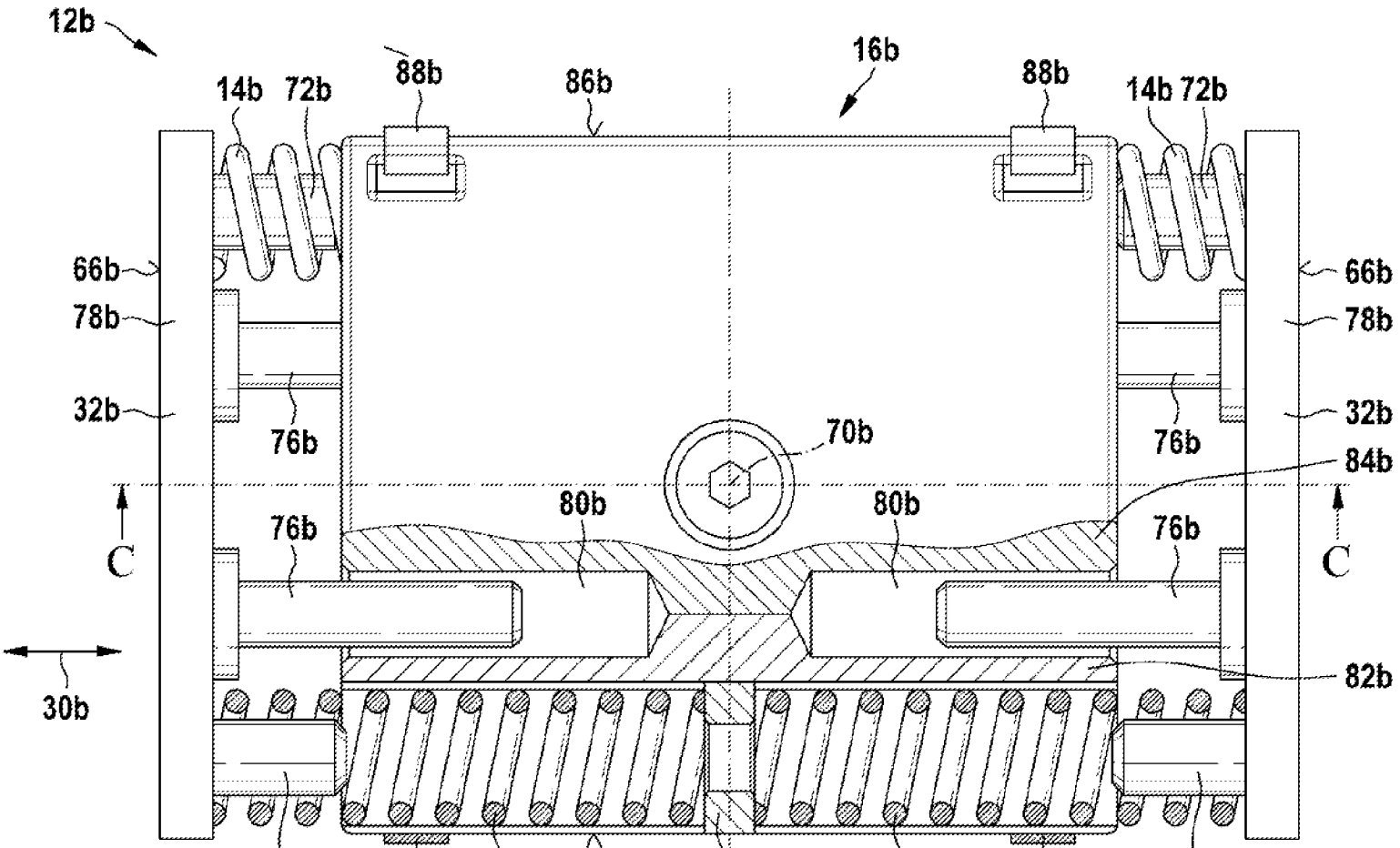
FIG. 8 shows a partial section of an alternative exemplary embodiment of the vibration absorber device from FIG. 1, comprising an absorber mass constructed from two mass parts.
Figure 9:
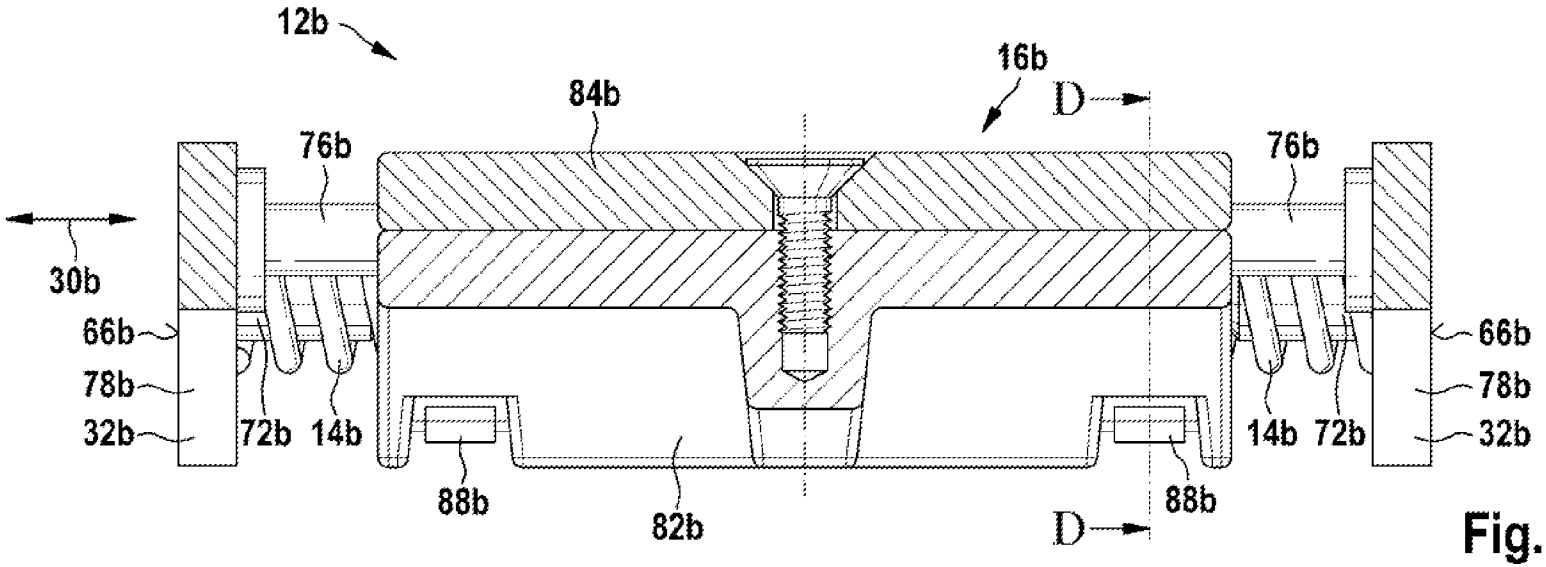
FIG. 9 shows a section (C-C) of the vibration absorber device from FIG. 8, in a front view.
Figure 10:
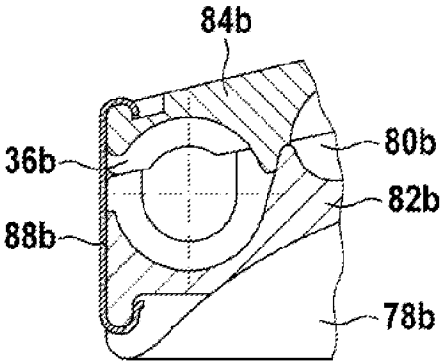
FIG. 10 shows a partial section (D-D) of the vibration absorber device from FIG. 8, in a side view.

The exemplary embodiment of FIGS. 8 to 10 relates, as described in the exemplary embodiment of FIGS. 1 to 7, to a hand power tool 10*b* according to the disclosure, having a vibration absorber device 12*b*, represented in FIGS. 8 to 10, a drive mechanism 18*b* and a mechanism housing 20*b* having a housing cover 22*b* and a housing shell 52*b*. The housing cover 22*b*, when in a state of operational readiness, closes a chamber 24*b*, in which the drive mechanism 18*b* is disposed. The housing cover 22*b* has fastening means 26*b* that, in a state of operational readiness, fasten the vibration absorber device 12*b*.

The vibration absorber device 12*b* has four absorber springs 14*b*, an absorber mass 16*b* and two holding parts 32*b*. The holding parts 32*b* are realized as like parts. Each holding part 32*b* has two spring fastening devices 72*b* and two guide means 76*b*. The guide means 76*b* are realized as rods formed onto a base plate 78*b* of the holding parts 32*b*. The guide means 76*b* engage in recesses 80*b* of the absorber mass 16*b* and guide the latter in the spring direction 30*b*. Alternatively, guide means 76*b* could also extend fully through the absorber mass 16*b* in the spring direction 30*b*.

The absorber mass 16*b* has a first and a second mass part 82*b*, 84*b*. The first mass part 82*b*, which faces toward a percussion mechanism 28*b* and which is represented at the bottom in FIG. 9, is approximately as heavy as the second mass part 84*b*. In general, a heaviest mass part has a mass that, at most, is four times as great as a lightest mass part.

A division between the two mass parts 82*b*, 84*b* runs parallel to the spring direction 30*b* and substantially parallel to a main extent of the absorber mass 16*b*. Alternatively, a division could also be disposed perpendicularly in relation to a main extent of an absorber mass or perpendicularly in relation to the spring direction. The mass parts are screwed to each other in the center. In addition, the mass parts 82*b*, 84*b* are clamped to each other on outer sides 86*b* by latching hooks 88*b*. The absorber mass 16*b* encloses the absorber springs 14*b* by more than 180 degrees, in this example completely, on a plane aligned perpendicularly in relation to the spring direction 30*b*. In the enclosed regions, the absorber mass 16*b* guides the absorber springs 14*b*.

Figure 11:
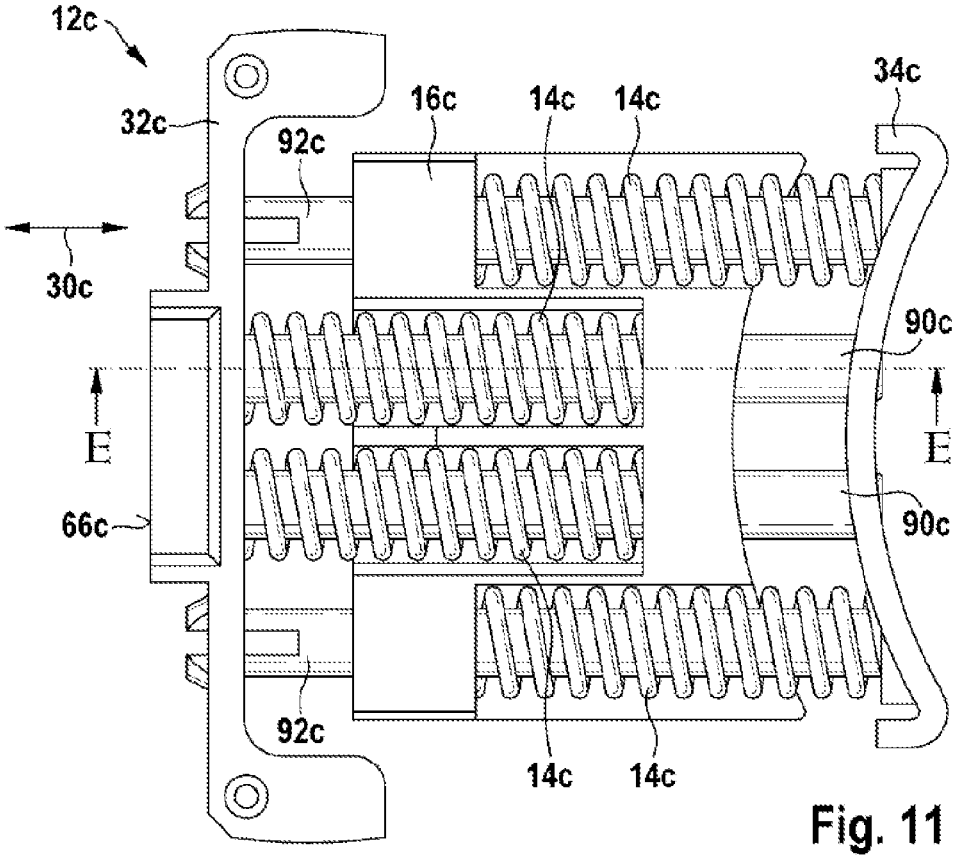
FIG. 11 shows a further, alternative exemplary embodiment of the vibration absorber device from FIG. 1, comprising two holding parts, which are supported on each other.
Figure 12:
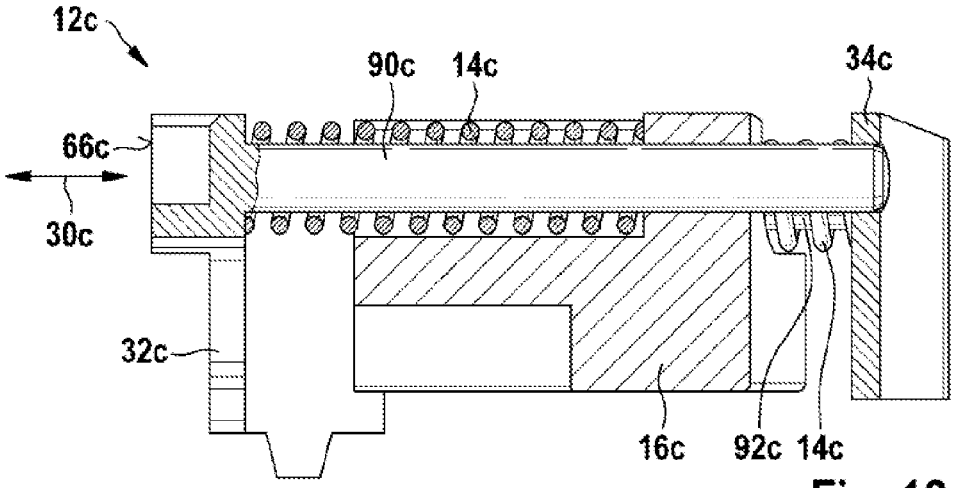
FIG. 12 shows a section (E-E) of the vibration absorber device from FIG. 11, in a front view.

The exemplary embodiment of FIGS. 11 and 12 relates, as described in the exemplary embodiments of FIGS. 1 to 7, to a hand power tool 10*c* according to the invention disclosure, having a vibration absorber device 12*c*, represented in FIGS. 11 and 12, a drive mechanism 18*c* and a mechanism housing 20*c* having a housing cover 22*c* and a housing shell 52*c*. The housing cover 22*c*, when in a state of operational readiness, closes a chamber 24*c*, in which the drive mechanism 186*c* is disposed. The housing cover 22*c* has fastening means 26*c* that, in a state of operational readiness, fasten the vibration absorber device 12*c*.

The vibration absorber device 12*c* has a first and a second holding part 32*c*, 34*c*. The first holding part 32*c* is disposed facing toward an insert tool fastening device 46*c*. The second holding part 34*c* is disposed facing away from the insert tool fastening device 46*c*. The first holding part 32*c* and the second holding part 34*c* are supported against each other through the absorber springs 14*c*. For this purpose, the two holding parts 32*c*, 34*c* each have two rod-shaped formed-on elements 90*c*, 92*c*. The formed-on elements 90*c* of the first holding part 32*c* extend through two of the absorber springs 14*c*. In this case, the formed-on elements 90*c* guide the absorber springs 14*c*. Ends of the formed-on elements 90*c*, which face away from a base plate 78*c* of the first holding part 32*c*, are movably mounted in a recess, or bore, of the second holding part 34*c*. The formed-on elements 92*c* of the second holding part 34*c* likewise extend through and guide two of the absorber springs 14*c*. Ends of the formed-on elements 92*c*, which face away from a base plate 78*c* of the second holding part 34*c*, extend through a recess, or bore, of the first holding part 32*c*. On a side of the first holding part 32*c* that faces away from the base plate 78*c* of the second holding part 34*c*, the formed-on elements 92*c* are latched on the first holding part 32*c*. The vibration absorber device 12*c* thus has more than two guide rods 90*c*, 92*c* that guide the absorber mass 16*c*.

It can be seen from FIG. 12 that the outer absorber springs 14*c* are disposed somewhat deeper, i.e. closer to the drive mechanism 18*c*, than the inner absorber springs 14*c*. In addition, all, i.e. the four, absorber springs 14*c* are partially disposed on a plane that is aligned perpendicularly in relation to the spring direction 30*c*. As a result, the vibration absorber device 12*c* can be integrated into the housing cover 22*c*in a particularly space-saving manner. Furthermore, only one of the two holding parts 32*c*, 34*c* is mechanically connected to the mechanism housing 20*c* in a fixed manner.

Figure 13:
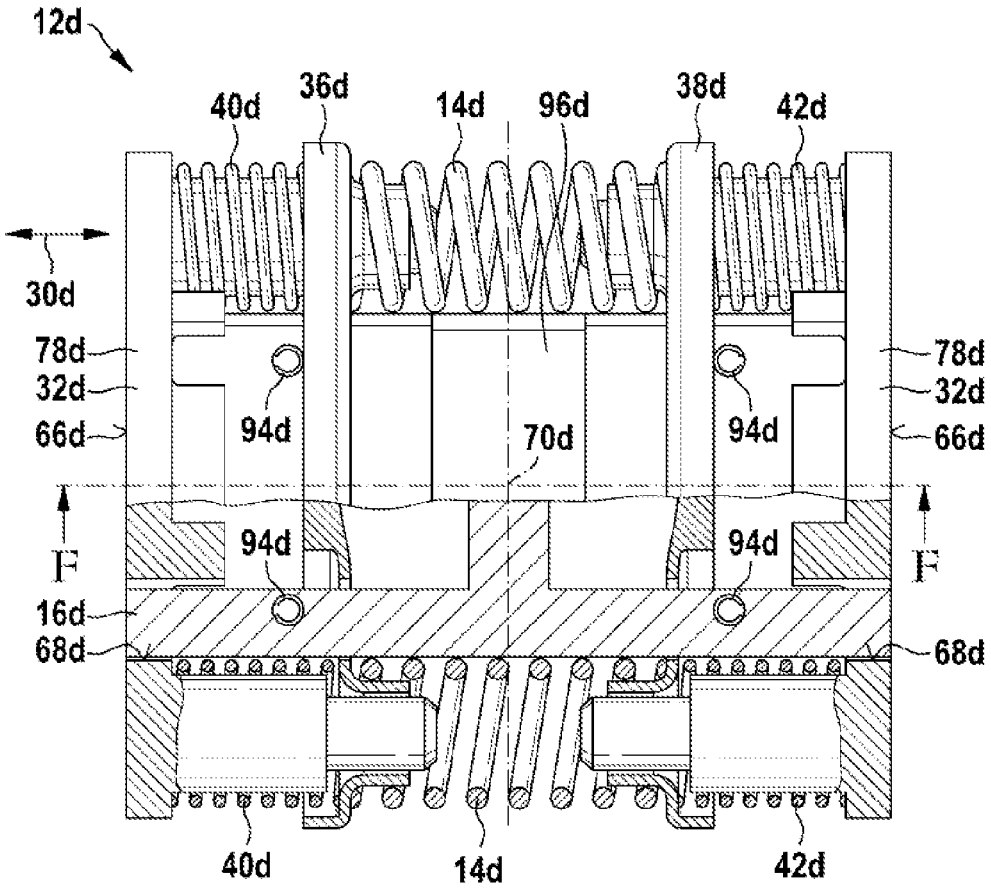
FIG. 13 shows a partial section of a further, alternative exemplary embodiment of the vibration absorber device from FIG. 1, comprising a spring receiver that is movable relative to the absorber mass.
Figure 14:
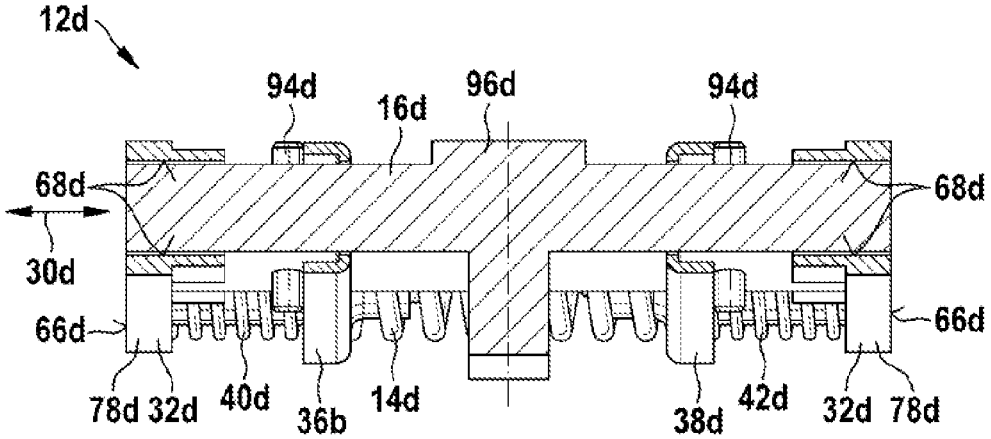
FIG. 14 shows a section (F-F) of the vibration absorber device of FIG. 13, in a front view.

The exemplary embodiment of FIGS. 13 and 14 relates, as described in the exemplary embodiments of FIGS. 1 to 7, to a hand power tool 10*d* according to the disclosure, having a vibration absorber device 12*d*, represented in FIGS. 13 and 14, a drive mechanism 18*d* and a mechanism housing 20*d* having a housing cover 22*d* and a housing shell 52*d*. The housing cover 22*d*, when in a state of operational readiness, closes a chamber 24*d*, in which the drive mechanism 18*d* is disposed. The housing cover 22*d* has fastening means 26*d* that, in a state of operational readiness, fasten the vibration absorber device 12*d*.

The vibration absorber device 12*d* has two absorber springs 14*d*, an absorber mass 16*d*, a first and a second holding part 32*d*, a first and a second spring receiver 36*d*, 38*d*, and four support elements 40*d*, 42*d*. The holding parts 32*d* are pushed onto the absorber mass 16*d*. There, the holding parts 32*d* are secured with locking elements 94*d*. The locking elements 94*d* are realized as clamping sleeves, but could also be realized as other units considered appropriate by persons skilled in the art. The holding parts 32*d* are mounted on the absorber mass 16*d* so as to be movable in the spring direction 30*d*, this being between two locking elements 94*d* and a middle offset 96*d* in each case. The middle offset 96*d* extends perpendicularly in relation to the spring direction 30*d*.

The first holding part 32*d* and the first spring receiver 36*d* are disposed facing toward the insert tool fastening device 46*d*. The absorber mass 16*d*, when in an operating state, moves the second spring receiver 38*d* in the direction of the insert tool fastening device 46*d*. In this case, the second spring receiver 38*d* exerts an acceleration force upon the absorber mass 16*d*. The acceleration force brakes the absorber mass 16*d*. The second spring receiver 38*d* in this case transfers a motional energy of the absorber mass 16*d* to the absorber springs 14*d*, via the locking elements 94*d*. The absorber springs 14*d* buffer this energy. After the absorber springs 14*d* have arrested the absorber mass 16*d* relative to the holding parts 32*d*, the absorber springs 14*d* deliver the energy back to the absorber mass 16*d* and, in so doing, accelerate the absorber mass 16*d*. In this movement of the absorber mass 16*d* from a central position in the direction of the insert tool fastening device 46*d*, the first spring receiver 36*d* supports a counter force of the acceleration force at the first holding part 32*d*. After the absorber mass 16*d* has crossed over a central position, the same operation is effected, in a mirror inverted manner, in the opposite direction.

The support elements 40*d*, 42*d* in two differing operating states press the spring receivers 36*d*, 38*d* against the absorber springs 14*d*. The support elements 40*d*, 42*d* are realized as support springs. A force of the support elements 40*d*, 42*d* in this case is significantly less than the acceleration force of the absorber springs 14*d*. The support elements 40*d*, 42*d* in this case are aligned coaxially in relation to the absorber springs 14*d*. The absorber springs 14*d* are disposed entirely in an axial region, i.e. laterally next to the absorber mass 16*d*.

The invention claimed is:

1. A hand power tool, comprising:

a drive mechanism, a mechanism housing defining (i) a chamber in which the drive mechanism is disposed and (ii) an opening leading into the chamber, at least one vibration absorber device which has at least one absorber spring, an absorber mass, and a first holding part supporting an outermost axial end of the absorber mass, the at least one absorber spring defining a spring direction and the first holding part engaging the absorber mass such that the first holding part, the absorber spring, and the absorber mass are at least partially disposed on at least one same plane that is aligned normal to the spring direction, and a housing cover having (i) an external surface facing away from the opening, (ii) an internal surface facing towards the opening, and (iii) at least one integrally-formed fastening mechanism extending from the internal surface and defining at least one planar fastening surface arranged normal to the spring direction, wherein the absorber spring is configured to press the vibration absorber device into the planar fastening surface such that the vibration absorber device is completely retained on the housing cover by contact between the vibration absorber device and the planar fastening surface, and wherein the housing cover and the retained vibration absorber device constitute a preassembled structural unit that (i) extends through the opening to the chamber and closes the chamber when the preassembled structural unit is connected to the mechanism housing and (ii) is spaced from and moveable relative to the hand power tool when the preassembled structural unit is disconnected from the mechanism housing.

2. The hand power tool as claimed in claim 1, wherein the at least one vibration absorber device and the drive mechanism are disposed in the chamber closed by the structural unit.

3. The hand power tool as claimed in claim 1, wherein the at least one absorber spring is configured to effect a fastening force upon the housing cover while the at least one vibration absorber device is retained on the housing cover.

4. The hand power tool as claimed in claim 1, wherein:

the drive mechanism has a percussion mechanism, and the percussion mechanism and the at least one vibration absorber device are at least partially disposed on at least one same plane that is aligned normal to the spring direction.

5. The hand power tool as claimed in claim 1, wherein:

the at least one vibration absorber device has second holding part, and the first holding part and the second holding part are supported against each other through the at least one absorber spring.

6. The hand power tool as claimed in claim 1, wherein the at least one vibration absorber device has at least one spring receiver that, in at least one operating state, exerts an acceleration force upon the absorber mass and, in at least one operating state, supports a counter force of the acceleration force on the first holding part.

7. The hand power tool as claimed in claim 6, wherein the at least one vibration absorber device has at least one support element that is configured to, in at least one operating state, press the spring receiver against the absorber spring.

8. The hand power tool as claimed in claim 1, wherein the at least one absorber spring is disposed entirely in an axial region of the absorber mass.

* * * * *